US006816044B2

(12) United States Patent
Mader et al.

(10) Patent No.: US 6,816,044 B2
(45) Date of Patent: Nov. 9, 2004

(54) ELECTRICAL SWITCHING ELEMENT

(75) Inventors: Leopold Mader, Moedling (AT); Rudolf Mikl, Arbesthal (AT)

(73) Assignee: Tyco Electronics Austria GmbH, Vienna (AU)

( * ) Notice: Subject to any disclaimer, the term of this patent is extended or adjusted under 35 U.S.C. 154(b) by 0 days.

(21) Appl. No.: 10/103,199

(22) Filed: Mar. 21, 2002

(65) Prior Publication Data

US 2002/0175787 A1 Nov. 28, 2002

(30) Foreign Application Priority Data

Mar. 22, 2001 (DE) ..... 101 14 158

(51) Int. Cl.[7] ..... H01H 67/02
(52) U.S. Cl. ..... 335/129; 335/130; 335/83
(58) Field of Search ..... 335/78–86, 202, 335/124–131

(56) References Cited

U.S. PATENT DOCUMENTS 4,310,818 A 1/1982 Essler et al.
4,533,889 A 8/1985 Knight
5,392,015 A * 2/1995 Matsuoka et al. ..... 335/78
5,834,998 A * 11/1998 Reiss et al. ..... 335/78
5,907,268 A 5/1999 Mader

FOREIGN PATENT DOCUMENTS

EP 0 409 613 A 1/1991 ..... H01H/50/14
WO WO 00/54296 9/2000 ..... H01H/50/02

OTHER PUBLICATIONS

European Search Report, dated Feb. 24, 2004, app. No. EP 02 00 5989.

* cited by examiner

*Primary Examiner*—Lincoln Donovan

(57) ABSTRACT

An electrical switching element comprising a housing having an elongated base. An electrical coil is wrapped around a yoke and arranged in the housing such that a center axis of the electrical coil is positioned parallel to the elongated base of the housing. An armature having a first switching contact is mounted in a sprung manner and in operative connection with the armature. A first low-profile contact is connected to the first switching contact, and a second low-profile contact is connected to the second switching contact.

21 Claims, 6 Drawing Sheets

Fig. 2a
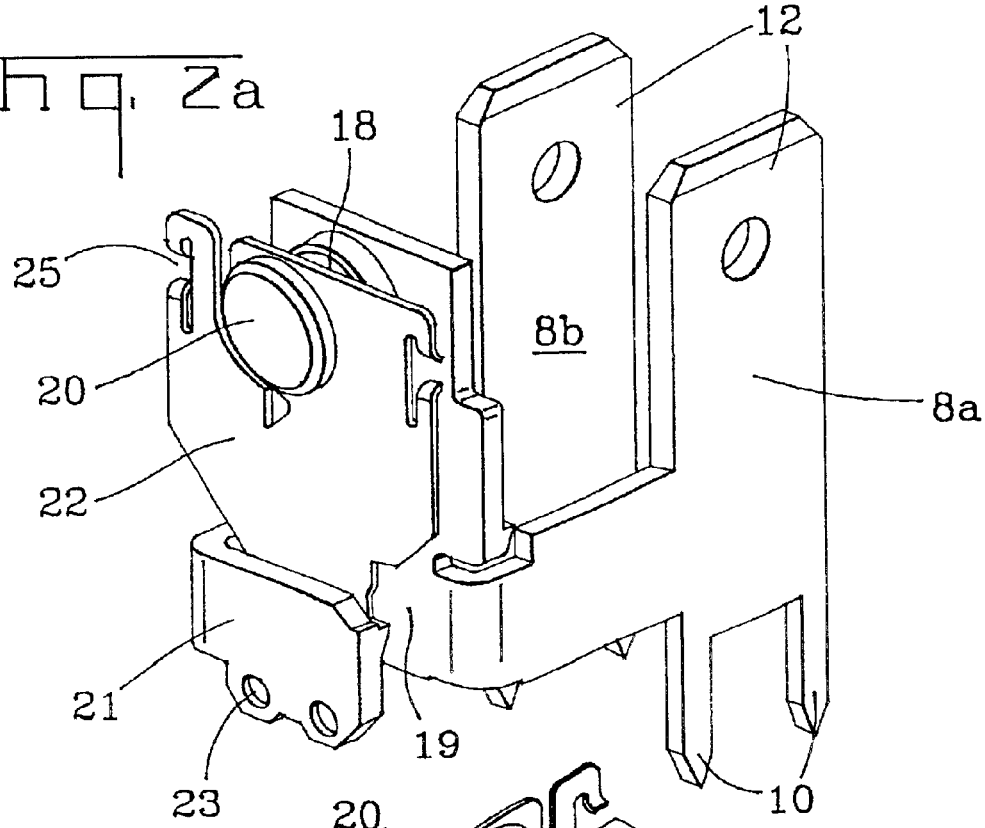
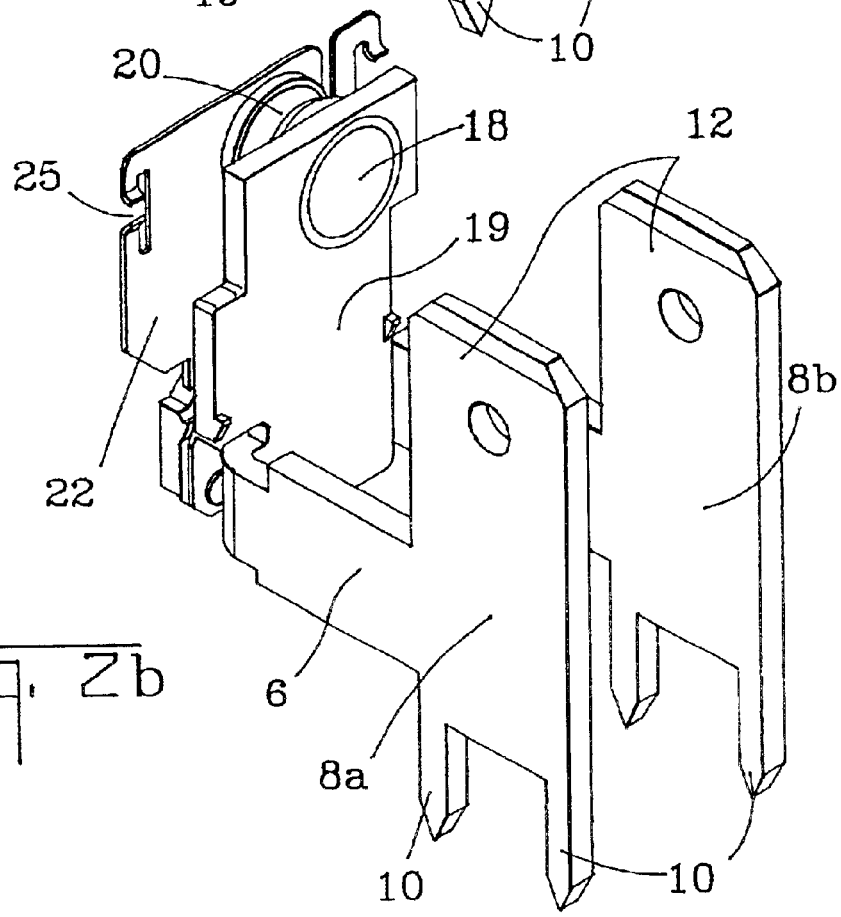
Fig. 2b

ELECTRICAL SWITCHING ELEMENT

BACKGROUND OF THE INVENTION

The present invention relates to an electrical switching element and, more particularly, to an electrical relay that mounts on a printed circuit board.

DESCRIPTION OF THE PRIOR ART

Electrical switching elements, such as electrical relays for mounting on printed circuit boards, typically have an electrical relay coil that stands perpendicular to the printed circuit board. Plug terminals for mounting on the printed circuit board and for connecting further plug contacts are conventionally pushed laterally into a carrier housing of the switching element and fixed thereto. The contact carriers are soldered to the switching element.

Because of the positioning of the electrical relay coil, these electrical switching elements have a relatively large overall height. The relatively large overall height restricts mounting the electrical switching element in spatially restricted locations, such as on LSI circuit boards.

It is therefore desirable to develop an electrical switching element of low overall height that is eminently suitable for being mounted in locations having spatial restrictions. It is further desirable to develop an electrical switching element of compact construction that also has carrier contacts that remain securely fixed even at relatively high temperatures and after relatively long periods of operation.

SUMMARY OF THE INVENTION

The invention relates to an electrical switching element comprising a housing having an elongated base. An electrical coil is wrapped around a yoke and arranged in the housing such that a center axis of the electrical coil is positioned parallel to the elongated base of the housing. An armature having a first switching contact is mounted in a sprung manner and in operative connection with the armature. A first low-profile contact is connected to the first switching contact, and a second low-profile contact is connected to the second switching contact.

BRIEF DESCRIPTION OF THE DRAWINGS

The invention will be explained below with reference to the attached drawings, in which:

FIG. 2*a* shows a first perspective view of the switching contacts shown in FIG. 1.

FIG. 2*b* shows a second perspective view of the switching contacts shown in FIG. 1.

FIG. 3 shows a perspective view of the base of the electrical switching element shown in FIG. 1.

DETAILED DESCRIPTION OF THE PREFERRED EMBODIMENT

Figure 1:
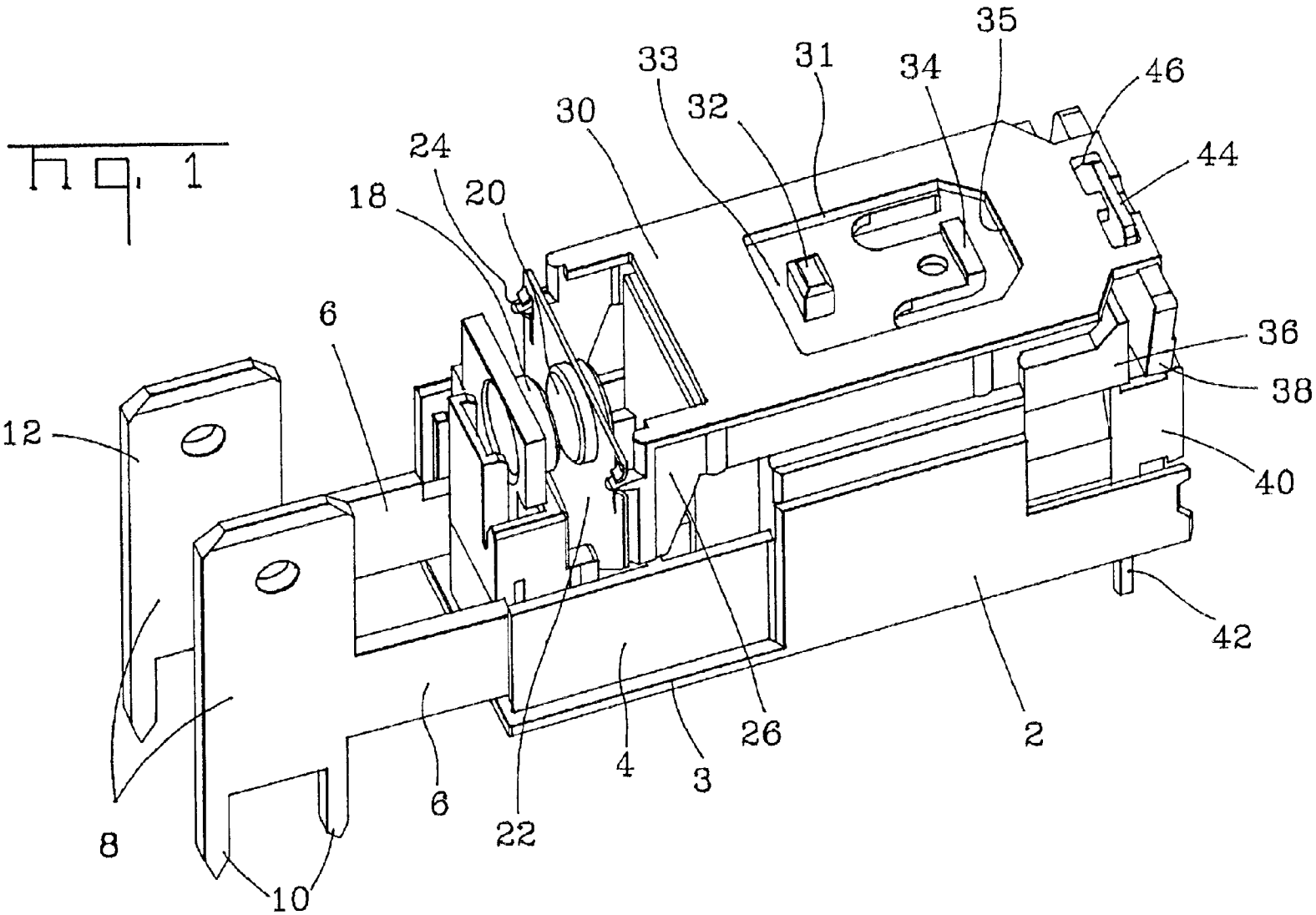
FIG. 1 shows a perspective view of an electrical switching element according to the invention.
Figure 7:
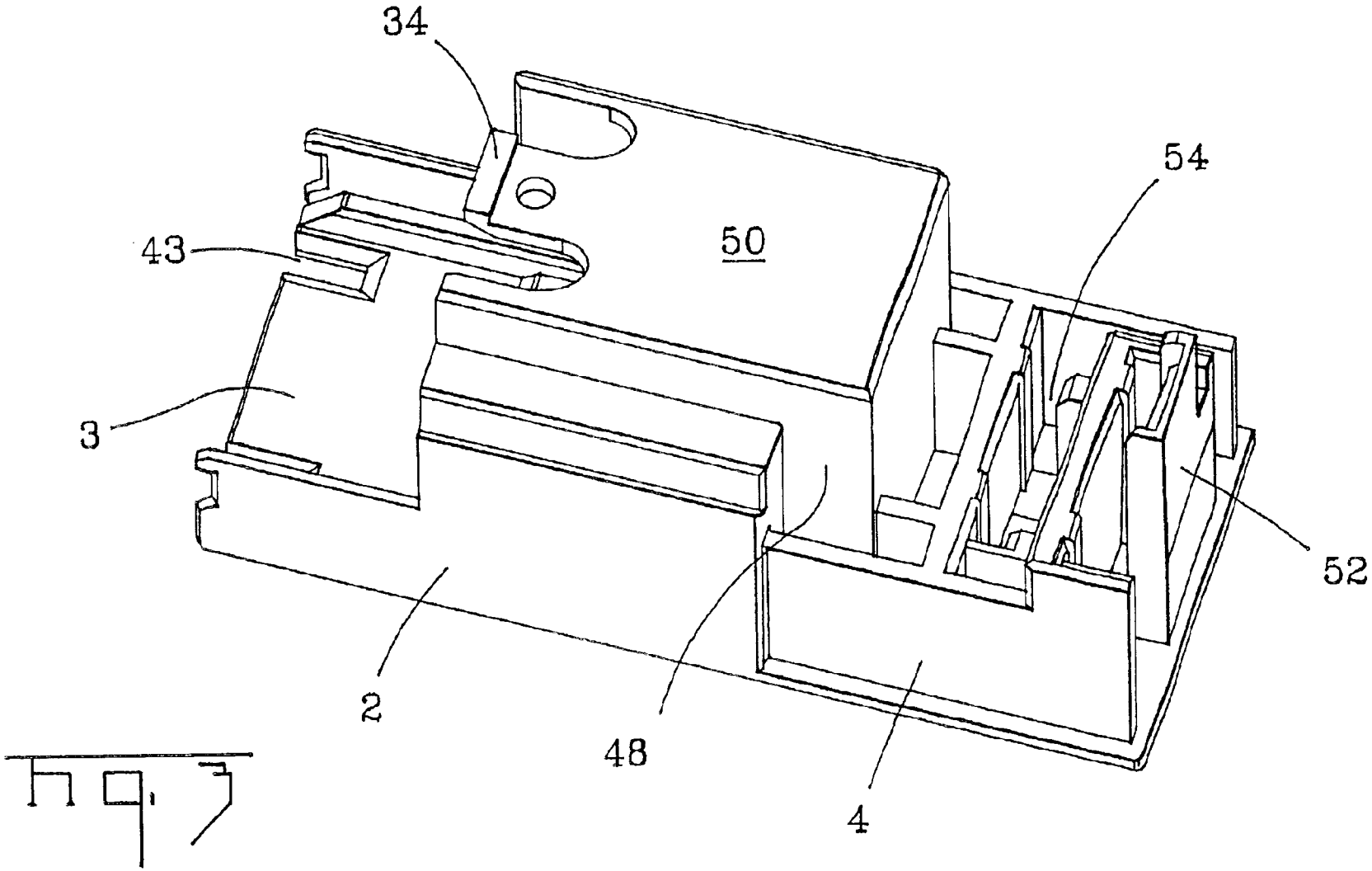

FIG. 1. shows a perspective view of an electrical switching element according to the invention. The electrical switching element is constructed as a relay and mounts on a printed circuit board (not shown). A relay coil (not shown) is arranged in a substantially rectangular elongate base 2. The relay coil (not shown) is positioned parallel to the base 2 and is wrapped around a yoke 36. The base 2 preferably has a base plate 3 that is positioned adjacent to the printed circuit board or the like and is soldered to the printed circuit board by means of a plurality of first solder contacts 10 and second solder contacts 42 that engage corresponding cutouts therein. Walls 4 serve to stabilise a housing with the components arranged therein. The housing comprises the base 2, the base plate 3 and the walls 4 and is preferably made from injection molded plastic materials. It will be understood and appreciated by those skilled in the art, however, that it is possible to use other insulating materials to obtain similar results.

An armature 38 is connected to the second solder contacts 42 by way of connection contacts 40. The armature 38 is constructed to be pivotal so that when the relay coil (not shown) carries current, the armature 38 is pulled against the yoke 36 or to the left in FIG. 1. The upper end side of the armature 38 has an entraining element 44. The entraining element 44 engages a corresponding cutout 46 in a substantially comb-shaped element 30 that is horizontally positioned above the housing, thus forming the upper termination thereof. The comb-shaped element 30 is longitudinally displaceable and is connected to a flat switch-over spring 22 arranged substantially perpendicular to the base plate 3. The comb-shaped element 30 is arranged such that the comb-shaped element 30 converts any pivotal movements of the armature 38 into a pivotal movement of the switch-over spring 22 through a linear movement of the comb-shaped element 30.

The comb-shaped element 30 has marginal walls 26 positioned remote from the armature 38. Each marginal wall 26 is drawn perpendicularly downwards and has a lateral end wall with a peg 24. Each of the pegs 24 engages a corresponding cutout 25 on lateral perpendicular edges of the switch-over spring 22 in a force-fitting manner. Resultantly, the switch-over spring 22 can be pivoted by the comb-shaped element 30. A contact face, designated as a second switching contact 20, is located approximately centrally on the switch-over spring 22 and can be constructed as a spring plate. The second switching contact 20 is positioned substantially flush with a fixed contact face, designated as a first switching contact 18. The first switching contact 18 is fixed in the housing such that the second switching contact 20, which is mounted to be sprung when the armature 38 is attracted, can be pressed firmly against the first switching contact 18 to ensure reliable electrical contact. This illustrated embodiment is also designated as a normally open contact, because the relay closes by means of the first and second switching contacts 18, 20 as soon as voltage is applied to the relay coil (not shown).

Each of the first and second switching contacts 18, 20 is in electrically conductive connection with a web 6 or is constructed to be an integral part thereof. Each web 6 merges into a low-profile contact 8. The two low-profile contacts 8 are each constructed as flat sheet-metal strips that have the downwardly pointing first solder contacts 10. The first solder contacts 10 preferably project beyond the contour of the base plate 3, such that when the base plate 3 is positioned adjacent to the printed circuit board, the first solder contacts 10 project through appropriate cutouts and can be soldered to circuit traces from below. The low-profile contacts 8 are constructed as upwardly pointing rectangular plug terminals 12 onto each of which a commercially available plug contact having a cable clamped or soldered thereto may be pushed if necessary.

FIGS. 2*a* and 2*b* show perspective views of the first and second switching contacts 18, 20 and the low-profile contacts 8 connected thereto. As shown in FIG. 2*a*, the switch-over spring 22 has a thin spring plate and is connected to the second switching contact 20, which is arranged approximately centrally thereon. A thicker securing plate 21, having bores 23, is anchored in the base 2 and forms a stable foundation for the switch-over spring 22 that is pivoted by the comb-shaped element 30. It is possible to discern the cutouts 25 that are made in the perpendicular edges of the switch-over spring 22 and in which the pegs 24 of the comb-shaped element 30 engage. The cutouts 25 can, for example, be made by means of a punching and bending procedure.

The securing plate 21 forms a unit with one of the webs 6 and is connected by way of the web 6 to one of the low-profile contacts 8*b*. The first switching contact 18 is arranged on a virtually rigid carrier plate 19 and forms a mechanical abutment when the first and second switching contacts 18, 20 are pressed against one another. The carrier plate 19 likewise forms a unit with the other web 6 and is connected by way of the other web 6 to the second low-profile contact 8*a*. Both the carrier plate 19 and the securing plate 21 are fixed in the base 2 and can be pushed into corresponding guides in the base 2 from above. The bores 23 in the securing plate 21 can, for example, be constructed as rivet connections for fixing the switch-over spring 22 to the securing plate 21. Similarly, the bores 26 may serve as securing bores for fixing the securing plate 21 to the base 2.

The individual parts illustrated in FIGS. 2*a* and 2*b* as a structural unit are not actually connected but are inserted individually into the base 2. only once the first and second switching contacts 18, 20 are closed is a connection between the parts created. The carrier plate 19, having connected thereto the web 6 and the low-profile contact 8*a*, can be made by a punching procedure followed by a bending procedure. The securing plate 21, having connected thereto the web 6 and the low-profile contact 8*b*, can be made in a similar manner and, then, connected to the switch-over spring 22.

FIG. 3 shows a perspective view of the base 2 of the electrical switching element showing the flat base plate 3 and the walls 4 that extend perpendicularly therefrom. The left-hand side of the base plate 3 has two discernible cutouts 43 that can be engaged by the second solder contacts 42. The cutouts 43, shaped in the manner of slots, allow the yoke 36 having the coil (not shown) located thereon to be pushed in laterally and the armature 38 to be subsequently secured to the connection contacts 40 for the solder contacts 42. The yoke 36 and the coil (not shown) are, in this case, encased in a substantially cuboid housing portion 48. The upper cover face of the cuboid housing portion 48 forms a bearing surface 50 for the comb-shaped element 30, which is laid flat and is slidable thereon. The comb-shaped element 30 is hingedly mounted between the armature 38 and the switch-over spring 22.

Shown in FIG. 3 and discernible on the right-hand side of the base plate 3, are the labyrinthine receiving openings 54 for the securing plate 21 and the carrier plate 19. The securing plate 21 and the carrier plate 19 are pushed in from above and anchored firmly and non-movably. Since the rigid carrier plate 19 is not of pivotal construction, a support 52 is provided therefor which projects substantially perpendicularly out of the base plate 3 and against which the carrier plate 19 abuts. A receiving opening 54 for the securing plate 21 is constructed such that the switch-over spring 22 has ample space for its pivotal movement.

The base illustrated in FIG. 3 may preferably be formed from an injection molded part, for example, made of plastic materials. If the base is made of metal, however, all the contact points with metal parts must be insulated.

Figure 4:
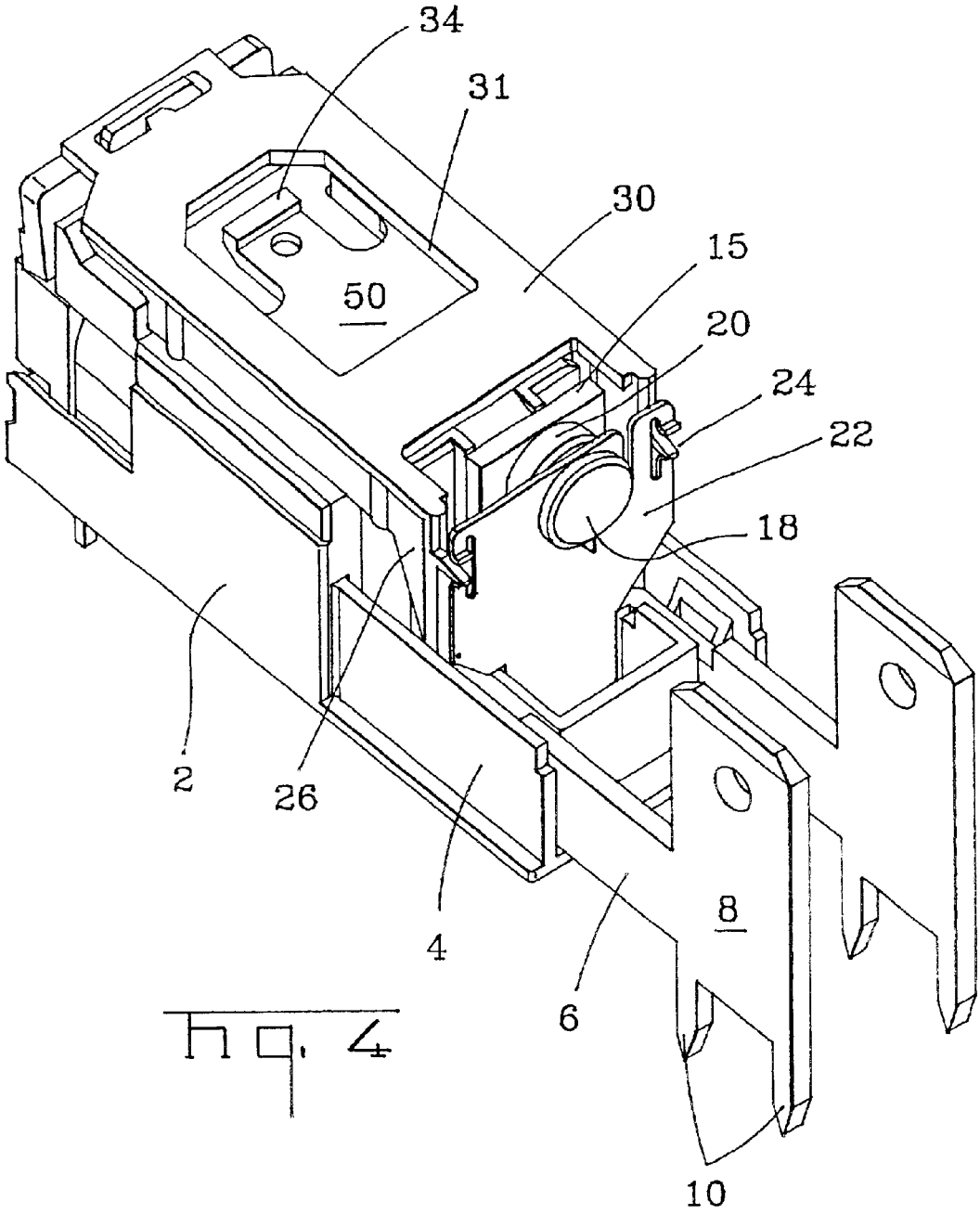
FIG. 4 shows a perspective view of a variant of the electrical switching element according to the invention.

FIG. 4 shows a variant of the electrical switching element according to the invention, in which the first and second switching contacts 18, 20 are in contact when the coil (not shown) is currentless or in normally closed contact. In this embodiment, the first switching contact 18, remote from the armature 38, is secured to a switch-over spring 22. The second switching contact 20, arranged on the rigid carrier plate 19, is in contrast firmly supported against a rear wall of the housing portion 48. The side walls 26 of the comb-shaped element 30 having the pegs 24 arranged thereon reach around both sides of the relatively narrow carrier plate 19 and by means of the pegs 24 engage in the corresponding cutouts 25 in the switch-over spring 22. When voltage is applied to the coil (not shown), the armature 38 is pulled against the yoke 36. As a result, the comb-shaped element 30 is displaced to the right and the switch-over spring 22 is pivoted, together with the first switching contact 18, to the right. The first and second switch-over contacts 18, 20 are consequently isolated from one another, as a result of which the relay contact is opened.

Figure 5A:
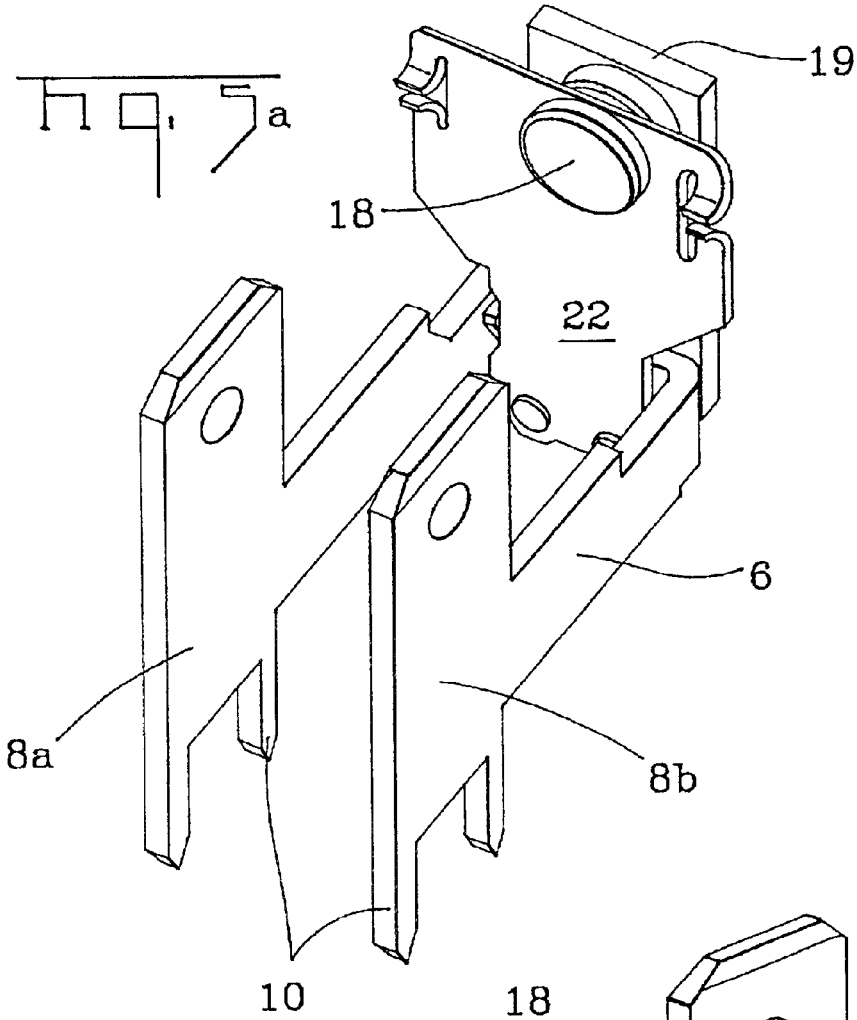
FIG. 5*a* shows a first perspective view of the switching contacts shown in FIG. 4.
Figure 5B:
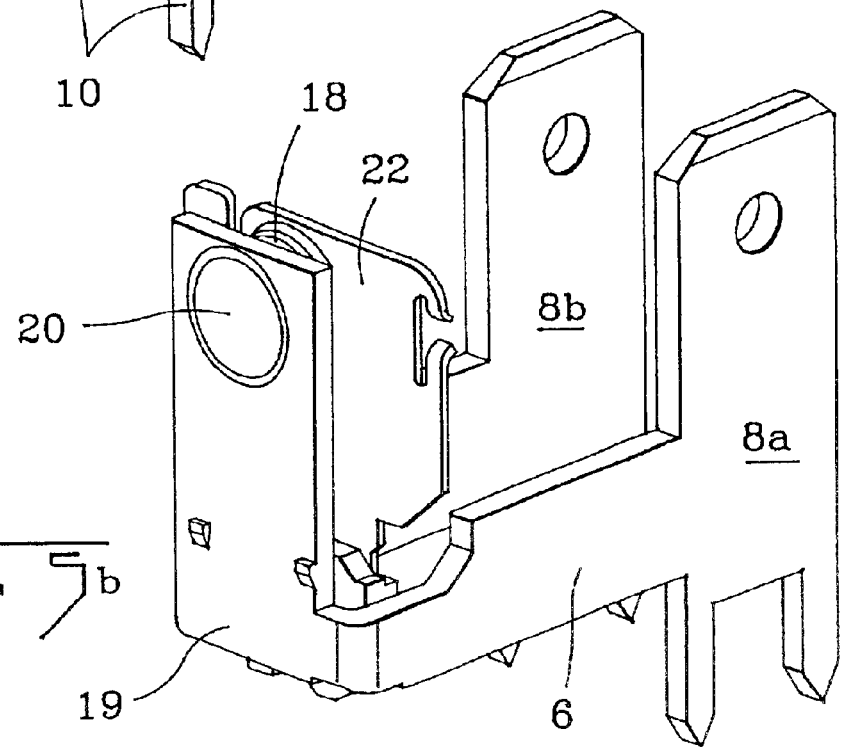
FIG. 5*b* shows a second perspective view of the switching contacts shown in FIG. 4.

FIGS. 5*a* and 5*b* show perspective views of the first and second switching contacts 18, 20 constructed as normally closed contacts and the low-profile contacts 8 connected thereto. In this embodiment, the first and second switching contacts 18, 20 are in physical contact with one another when no voltage is applied to the coil (not shown) and when the armature 38 is not bearing on the yoke 26. The rigid carrier plate 19 has the second switching contact 20, while the movable switch-over spring 22 carries the first switching contact 18. The carrier plate 19 is connected by way of the web 6 to the low-profile contact 8*a*, while the switch-over spring 22 is connected by way of the securing plate 21 and the web 6 to the low-profile contact 8*b*. Actuation of the contacts through pivoting of the switch-over spring 22 takes place as described above, by way of the comb-shaped element 30 that is connected to the switch-over spring 22 and is in turn connected to the armature 38.

Figure 6:
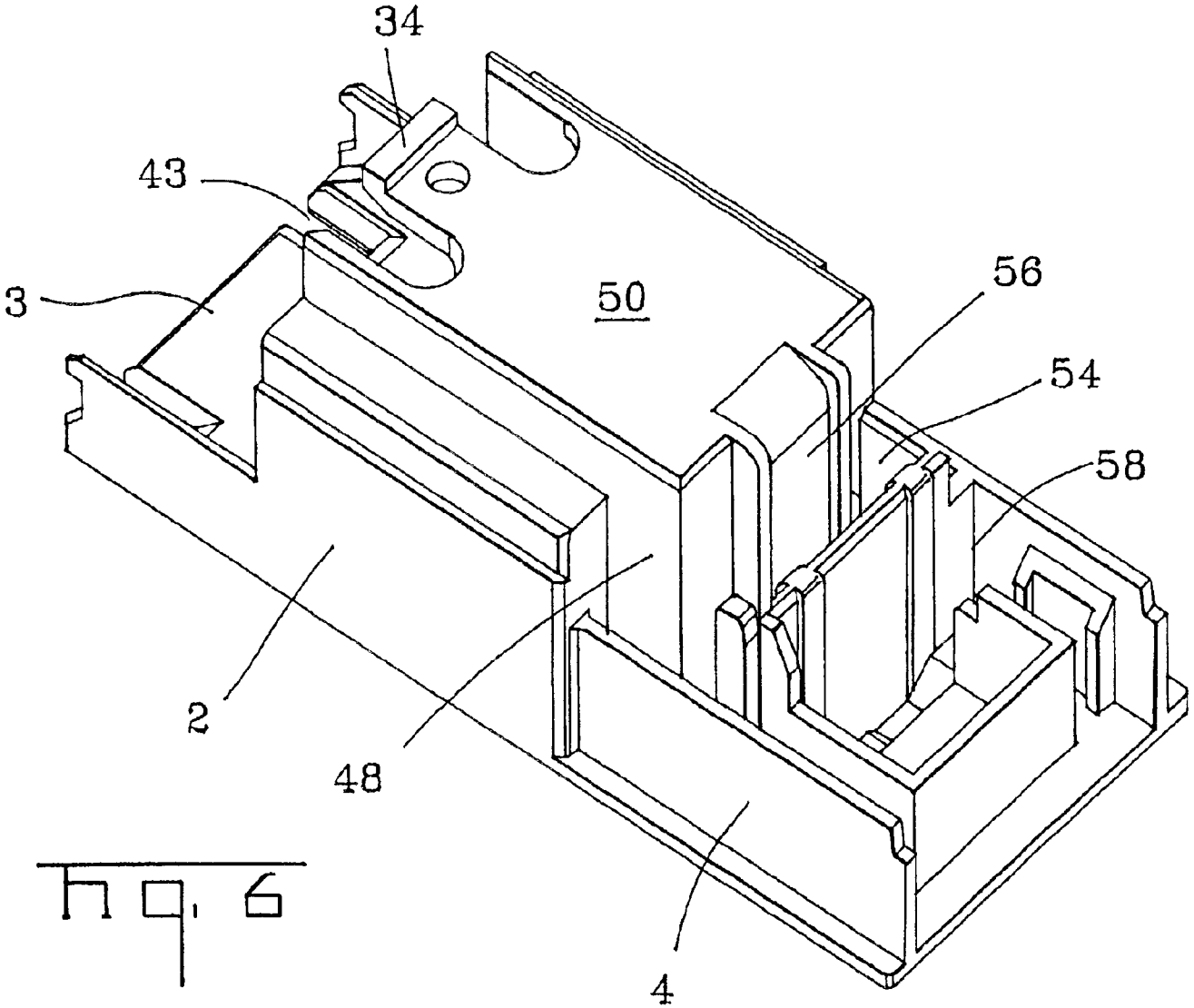
FIG. 6 shows a perspective view of the base of the electrical switching element variant shown in FIG. 4.

FIG. 6 shows a perspective illustration of the base 2 according to the variant in FIG. 4. In this embodiment, the base 2 substantially corresponds to that of the base 2 shown in FIG. 3. However, the receiving openings 54, 58 for the carrier plate 19 and the securing plate 21 are of a different construction to take account of the modified functioning of the switching contacts 18, 20 as normally closed contacts. The carrier plate 19 is adjacent to the cuboid housing portion 48 whereof the perpendicular wall remote from the armature 38 forms an abutment surface 56 for the carrier plate 19 that may be pushed perpendicularly from above into the receiver opening 54. A further receiver opening 58 receives the securing plate 21 with the switch-over spring 22 fixed thereto and the first switching contact 18 arranged thereon. The webs 6 each lie against cutouts and are held by the inner sides of the walls 4.

The electrical switching element according to the invention has the advantage that the electrical switching element has a particularly low overall height and is eminently suitable for being mounted lying in locations where spatial conditions are restricted. Moreover, the invention provides for the electrical switching element constructed as an electrical relay to be provided for mounting on a printed circuit board, which has the further advantage of a very compact construction. It is also possible for processing of the electrical switching element according to the invention to be automated.

In a further embodiment of the invention, the low-profile contacts 8 each have at least one downwardly projecting first solder contact 10, as a result of which the electrical switching element according to the invention is particularly simple to set on and solder to a pre-bored printed circuit board. The invention also provides for the housing to have at least two downwardly projecting second solder contacts 42 that are connected to the coil. With this construction, the coil is also connected directly to the printed circuit board and may be triggered by further circuits located on the printed circuit board.

The low-profile contacts 8 are each constructed as a low-profile plug whereof the flat plug terminals 12 project upwards. This has the advantage that in each case cable connections may be made with the plug terminals 12. In this way, space-saving and universal electrical connections may be made.

The housing having the coil arranged lying therein has an elongate contour, which has the advantage of a compact and flat structural shape which is particularly suitable for space-saving assembly on a printed circuit board. Further, the coil center axis is arranged parallel to the direction of the elongated base 2, which has the advantage of a compact structural shape.

An embodiment of the invention provides for the armature 38 of the coil and the switching contacts 18, 20 to be arranged on mutually opposing end sides of the elongate housing, which has the advantage of a very compact structural shape of the electrical switching element. As a result of arranging the contacts and the coil on mutually opposing end sides, the coil can exert sufficiently large forces for switching the contacts even with a low overall size.

An embodiment according to the invention provides for at least one of the switching contacts 18, 20 to be in operative connection with the armature 38 of the coil by way of a comb-shaped element 30, which has the advantage of good mechanical coupling; that is to say that the contacts can be closed and opened (made and broken) using small switching forces, as a result of which only a very small coil is required.

In a further embodiment of the invention, one of the sprung switching contacts, the comb-shaped element 30 and the armature 38 are each movable in a direction parallel to the coil center axis, which has the advantage of a virtually ideal mechanical operative connection and thus of being able to make the electrical switching element with minimal overall size.

An embodiment according to the invention provides for the switching contacts 18, 20 to be in contact in the currentless condition of the coil. These switching contacts 18, 20 constructed as so-called normally closed contacts have the advantage of bringing about minimal current consumption in the coil, depending on the desired application.

An alternative embodiment of the invention provides for the switching contacts 18, 20 to be in contact when voltage is applied to the coil. These switching contacts 18, 20 constructed as so-called normally open contacts have the advantage of bringing about only minimal current consumption in the electrical coil, depending on the desired purpose of use.

Those skilled in the art will see that the invention described here is not restricted to the example embodiment illustrated but that it also encompasses a number of variants and modifications thereof.

We claim:

1. An electrical switching element, comprising:

a housing having an elongated base;

a yoke arranged in the housing;

an electrical coil wrapped around the yoke and having a center axis positioned parallel to the elongated base of the housing;

an armature;

a first switching contact mounted in a sprung manner and in operative connection with the armature;

a second switching contact positioned adjacent to the first switching contact;

a first low-profile contact connected to the first switching contact;

a second low-profile contact connected to the second switching contact;

each of the first and second low-profile contacts being electrically connected to the respective first and second switching contacts by a web extending therebetween; and the first low-profile contact having a first plug terminal and the second low-profile contact having a second plug terminal for attachment of a plug contact, the first and second plug terminals extending perpendicular to a base plate of the base of the housing.

2. The electrical switching element of claim 1, wherein the first low-profile contact has a first solder contact and the second low profile contact has a second solder contact for attachment to a printed circuit board.

3. The electrical switching element of claim 1, wherein the housing has a third projecting solder contact and a fourth projecting solder contact connected to the electrical coil.

4. The electrical switching element of claim 1, wherein the housing is made from a molded plastic material.

5. The electrical switching element of claim 1, wherein the first switching contact is connected to the armature by a comb-shaped element.

6. The electrical switching element of claim 5, wherein the first switching contact, the comb-shaped element, and the armature are each movable in a direction parallel to the electrical coil center axis.

7. The electrical switching element of claim 1, wherein the first and the second switching contacts are in contact when the electrical coil is in a currentless state.

8. The electrical switching element of claim 1, wherein the first and the second switching contacts are in contact when voltage is applied to the electrical coil.

9. The electrical switching element of claim 1, wherein the first switching contact is pivotal by way of a switch-over spring.

10. The electrical switching element of claim 9, wherein the switch-over spring is attached to a comb-shaped element that is positioned such that any pivotal movements of the armature causes the comb-shaped element to pivot the switch-over spring.

11. The electrical switching element of claim 9, wherein the switch-over spring has a securing plate anchored to the elongated base.

12. The electrical switching element of claim 1, wherein the first switching contact and the second switching contact have a metallically coated contact surface.

13. An electrical switching element, comprising:

a housing having an elongated base;

a yoke arranged in the housing;

an electrical coil wrapped around the yoke and having a center axis positioned parallel to the elongated base of the housing;

an armature;

a first switching contact is mounted in a sprung manner and in operative connection with the armature by a comb-shaped element;

a second switching contact is fixed adjacent to the first switching contact;

a first low-profile contact connected to the first switching contact;

a second low-profile contact connected to the second switching contact;

each of the first and second low-profile contacts being electrically connected to the respective first and second switching contacts by a web extending therebetween;

the first low-profile contact having a first plug terminal and the second low-profile contact having a second plug terminal for attachment of a plug contact, the first and second plug terminals extending perpendicular to a base plate of the base of the housing, the first low-profile contact having a first solder contact and the second low-profile contact having a second solder contact for attachment to a printed circuit board; and wherein the first switching contact, the comb-shaped element, and the armature are each movable in a direction parallel to the electrical coil center axis.

14. The electrical switching element of claim 13, wherein the first low profile contact has a first plug terminal and the second low profile contact has a second plug terminal for attachment of a plug contact.

15. The electrical switching element of claim 13, wherein the housing has a third projecting solder contact and a fourth projecting solder contact connected to the electrical coil.

16. The electrical switching element of claim 13, wherein the first and the second switching contacts are in contact when the electrical coil is in a currentless state.

17. The electrical switching element of claim 13, wherein the first and the second switching contacts are in contact when voltage is applied to the electrical coil.

18. The electrical switching element of claim 13, wherein the first switching contact is pivotal by way of a switch-over spring attached to the comb-shaped element such that any pivotal movements of the armature causes the comb-shaped element to pivot the switch-over spring.

19. The electrical switching element of claim 1, wherein each of the webs merges into one of the first and second low-profile contacts.

20. The electrical switching element of claim 13, wherein each of the webs merges into one of the first and second low-profile contacts.

21. The electrical switching element of claim 18, wherein the comb-shaped element has walls extending perpendicularly therefrom, the walls having lateral pegs for pivotally mounting the switch-over spring.

* * * * *